US005301484A

United States Patent [19]

Jansson

[11] Patent Number: 5,301,484

[45] Date of Patent: Apr. 12, 1994

[54] DEVICE FOR MOUNTING GLASS FACADE ELEMENTS

[76] Inventor: Nils-Gunnar Jansson, Enbärsstigen 3B, S-133 36 Saltsjöbaden, Sweden

[21] Appl. No.: 992,688

[22] Filed: Dec. 21, 1992

[30] Foreign Application Priority Data

Dec. 30, 1991 [SE] Sweden ..... 9103855

[51] Int. Cl.[5] ..... E04B 2/88

[52] U.S. Cl. ..... 52/235; 52/122.1; 52/511

[58] Field of Search ..... 52/235, 486, 487, 510, 52/127.6, 122.1, 508, 509, 511, 479

[56] References Cited

U.S. PATENT DOCUMENTS

| | | | |
|---|---|---|---|
| 3,550,337 | 12/1970 | Lorenz | 52/235 X |
| 3,936,986 | 2/1976 | Steel . | |
| 4,070,835 | 1/1978 | Reverand et al. . | |
| 4,625,481 | 12/1986 | Crandell | 52/235 |
| 5,094,051 | 3/1992 | Miller | 52/235 |
| 5,155,958 | 10/1992 | Huff | 52/235 |

FOREIGN PATENT DOCUMENTS 0100431 6/1983 European Pat. Off. .

*Primary Examiner*—Carl D. Friedman
*Assistant Examiner*—Robert J. Canfield
*Attorney, Agent, or Firm*—Nies, Kurz, Bergert & Tamburro

[57] ABSTRACT

A device for fitting glass facade elements to a building facade, in which the facade elements are glued to profiled sections which are secured to the building facade by means of fastener devices, such as screws. The invention is characterized in that the device includes three parts, a first part (2; 22) intended to be fastened in the facade, a second part (3; 23) which is intended to be glued to the upper edge of the facade element (1), and a third part (4; 24) which is intended to be glued to the bottom edge of the element (1) . The first part (2) includes an upwardly facing channel (7) which is intended to coact with a downwardly extending tongue (8) belonging to the third part (4; 24), and further includes a downwardly extending tongue (9) which extends parallel with the channel (7) and which is located on a lower level than the channel (7) and which is intended to coact with an upwardly open pocket (10) belonging to the second part (3; 23). The pocket (10) is provided with a flat glue surface (11) which is intended to be glued to the upper part (12) of a facade element (1). The third part (4; 24) includes a glue surface (13) which is intended to be glued to the bottom part (14) of a facade element (1), the glue surface (13) being parallel with the tongue (8), and further includes a supportive surface (15) which extends at right angles outwardly from the glue surface (13) and against which the bottom edge (16) of a facade element is intended to rest. In a fitted state, the distance from the bottom edge of the tongue (9) of the first part through the bottom (11) of the pocket (10) exceeds the depth of the upwardly facing channel (7). FIG. 5 for publication.

6 Claims, 3 Drawing Sheets

DEVICE FOR MOUNTING GLASS FACADE ELEMENTS

The present invention relates to a device for mounting glass facade elements in position. The invention is primarily concerned with facade elements in the form of panes of glass which are attached to a body structure comprising a number of profiled sections which are joined to form a building facade.

When erecting fully-glazed building facades in accordance with know methods, the glass panes are attached mechanically to the facade structure with the aid of different mechanical devices. These attachment devices, however, remain visible on the final facade structure, to a greater or lesser extent.

Consequently, there is a desire to eliminate the use of such mechanical devices and instead to glue the panes of glass to a rearwardly-lying framework secured to the facade.

However, gluing of the glass panes cannot be achieved readily on the building site, and consequently the quality of the glue joints obtained may vary, among other things, because of weather conditions, resulting in the risk that a glass pane may loosen and fall to the ground, causing damage and injury.

The present invention relates to a somewhat different glass facade, namely a glass facade in which glass panes are suspended from a facade to form a facade cladding. Preferably, the glass panes are not transparent, but are instead treated to give the repression of some form of stone cladding for instance.

The most serious problem in this respect is that the glass panes cannot be glued to a framework or like structure on the working site, in a manner which will ensure that the joint are of satisfactory quality, for instance due to varying weather conditions, as before mentioned.

When the panes of glass are glued in the factory under controlled conditions, so as to provide high quality glue joints, the problem arises of fastening such glazed facade elements, which include some type of profiled section, to a framework or like structure on the house facade without inducing static stresses in the glue joints. This is because, in practice, house facades are never completely flat and smooth.

Another problem encountered with facade elements of the kill intended here is that it is difficult to replace individual elements, e.g. elements that may have been broken.

The present invention solves these problems and provides a device for erecting or installing glass facade elements where all gluing work can be carried out in the factory and where static loads are essentially avoided and with which each individual facade element can be easily replaced.

The present invention thus relates to a device for securing a glass facade element on a building facade, where said facade elements are glued to profiled sections which are secured in the facade by of fastener devices such as screws, and is characterized in that the device includes three parts, a first part which is intended to be attached in the facade, a second part which is intended to be glued to the upper edge of the facade element and a third part which is intended to be glued to the bottom edge of said element; in that the first part includes an upwardly-facing channel which is intended to coact with a downwardly extending tongue belonging to the third part and further includes a downwardly directed tongue which is located on a lower level than the channel and extends parallel with said channel and which is intended to coact with an upwardly open pocket belonging to the second part, said pocket being provided with a flat glue surface which is intended to be glued to the upper part of a facade element; in that the third part includes a glue surface which is intended to be glued to the bottom part of a facade element and which extends parallel with said tongue, and further includes a supportive surface which extends out at right angles from the glue surface and on which the bottom edge of a facade element is intended to rest; and in that in a mounted state, the distance from the bottom edge of the tongue of the first device part to the bottom of the pocket exceeds the depth of said upwardly facing groove.

The invention will now be described in more detail with reference to exemplifying embodiments thereof and also with reference to the accompanying drawings, in which FIG. 1 illustrates a facade elevation comprising a small number of facade elements;

Figure 1:
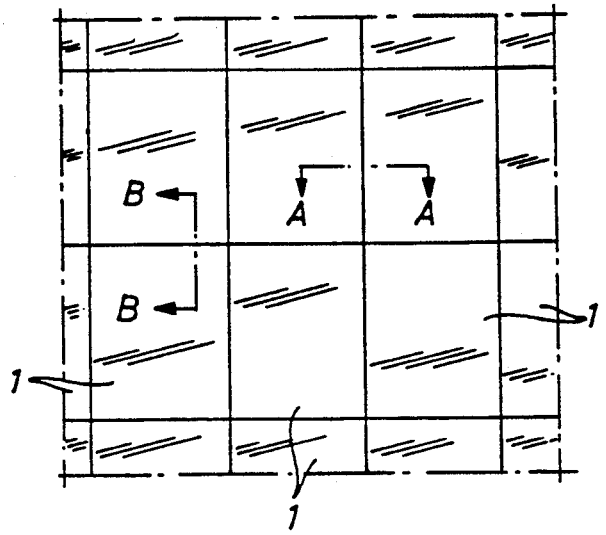
Figure 2:
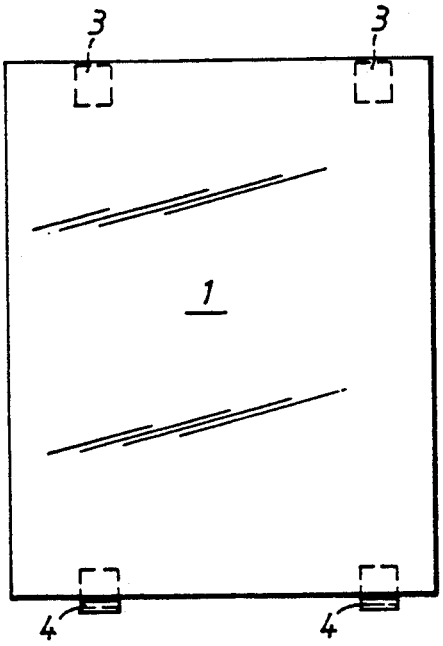
FIG. 2 illustrates only one such facade element.

FIG. 1 illustrates a number of mutually contiguous facade elements 1. FIG. 2 illustrates one such glass facade element from above. Although the invention is described in the following with reference to a glass facade element, it will be understood that the present invention can also be applied with facade elements that are made of some other material, for instance a thin stone or concrete material.

Figure 4:
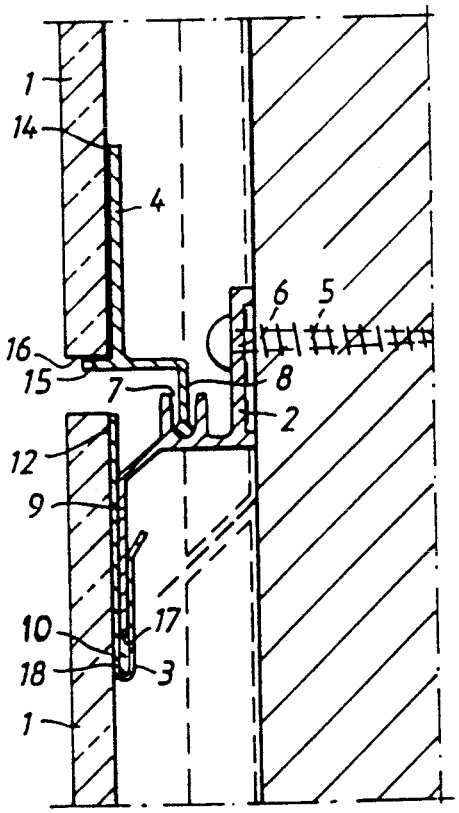
FIG. 4 is a sectional view taken on the line B—B in FIG. 1, in larger scale.
Figure 5:
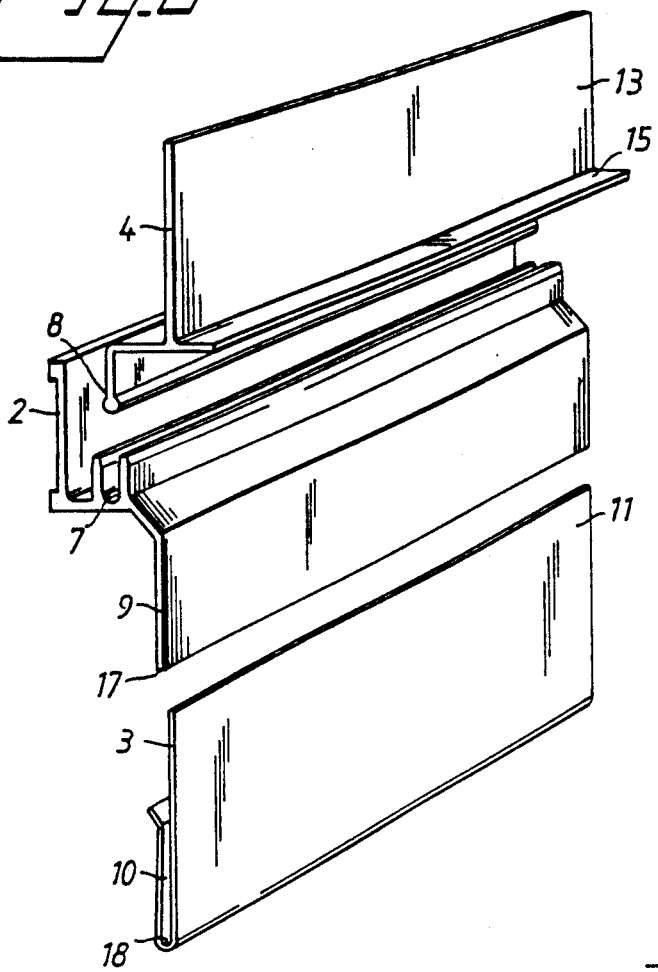
FIG. 5 illustrates in perspective the component members of an inventive device.

According to the invention, the device is comprised of three parts 2, 3, 4, as illustrated in FIGS. 4 and 5. A first part 2 is intended to be fastened to the building facade by of a screw 5 or bolt. The screws or bolts are received in one or more holes 6 provided in said first part. A second device part 3 is intended to be glued to the upper edge of the element 1, while a third device part 4 is intended to be glued to the bottom edge of said element.

The first part 2 includes an upwardly-facing channel 7 which is intended to coact with a downwardly tongue 8 on the third part 4, and further includes a tongue 9 which extends parallel with the channel 7 and which is located on a lower level than said channel. The tongue 9 is intended to coact with an y open pocket 10 provided on the second part 3. The outer surface of the pocket 10 has a flat glue surface 11 and is intended to be glued to the upper part 12 of a facade element. The third part 4 also includes a glue surface 13 which is intended to be glued to the bottom part 14 of a facade element. This glue surface 13 is parallel with the tongue 8 of the third part of said device.

The third part 4 also includes a supportive surface 15 which projects at right angles from the glue surface 13 and on which the bottom edge 16 of a facade element 1 is intended to rest. This supportive surface 15 functions to support the full weight of the facade element, instead of the weight being supported by a glue joint.

One important feature of the inventive device is that when the device is fitted, the distance from the bottom edge 17 of the tongue 9 of the third device part 4 to the bottom 18 of the pocket 10 will exceed the depth of the upwardly turned channel 7. As will be seen from FIG. 4, this enables a fitted facade element to be moved upwards in its own plane to an extent sufficient for the bottom edge of said element, and therewith also the tongue 8 of the third part 4 glued thereto, to be moved in a direction outwardly from the facade, so as to loosen the third part 4 from the first part 2 of said device. The facade element can then be moved downwardly in its own plane, therewith also loosening the second part 3 at the upper part of the facade element from the first part 2 of said device.

Thus, each individual facade element can be removed from the facade structure and replaced with a new element, without affecting the remaining facade elements.

According to one important embodiment of the invention, the channel 7 of the first device part 2 has a width which will enable the downwardly extending tongue 8 of the third device part 4 to pivot in the channel 7, to a limited extent and will sit essentially straight, without flexing, in and along the channel 7 of a first part 2, which may be slightly flexed from a straight line. This means, because the third part 4 is not flexed or bowed by the fit into channel 7, that no static forces will occur on the glue joints between the part 4 and the facade element as a result of the attachment of the facade element in its lower region. It will be understood that facades are practically never completely flat and consequently each attachment device 2 which is totally rigid and does not provide an oversize fit for limited pivoting or non-flexed cooperation of the tongue 8 or part 4, will induce static stresses in the glue joints as a result of fastening the facade element to the facade. This same feature is present in the relative interfit between the pocket 25 of the second part 23 and the tongue 29 of the first part 22 of the second embodiment, as shown in FIG. 6 and described hereinafter.

Another equally important embodiment is one in which the pocket 10 is comprised of a metal plate, preferably a stainless steel plate, which is folded to form said pocket and which is resilient relative to the downwardly extending tongue 9 of the first device part coacting with said pocket. A poorer alternative would be to provide the pocket in a direction perpendicular to the facade with a width sufficient to enable each facade element to be removed as before described. This arrangement would leave a permanent gap.

The fact that the pocket 10 is resilient and that the tongue 9 is movable in its own plane in the pocket 10 means that the glue joint on the facade element is relieved of all static forces to a very large extent as a result of the facade element attachment. Furthermore, movement of the tongue 9 in the pocket 10 enables tolerances between the attachment devices to be taken-up. Similarly, variations in dimensions caused by changes in temperature can also be taken-up in this way, and consequently the glue joints will not be subjected to static loads as a result of temperature variations.

Figure 6:
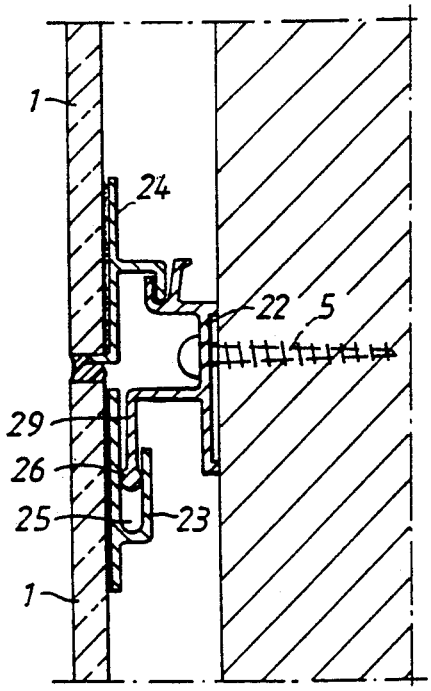
FIG. 6 illustrates an alternative embodiment.

FIG. 6 is a sectional view corresponding to FIG. 4 and shows an alternative embodiment of the downwardly extending tongue 9 of the first device part and of the second device part.

According to this embodiment, the second part 23 is comprised, for instance, of extruded alumunium and has a rigid or non-resilient pocket 25. The lower end of the downwardly extending tongue 29 of the first part 22 has a widened part 26 which is preferably of circular cross-sectional shape. This widened part 26 has a diameter which corresponds to the width of the pocket 25. Because the part 26 is enlarged in comparison with the tongue 29, the second device part 23 will be able to pivot in relation to the first part 22 to a limited extent. This embodiment thus provides a pivotal connection without the occurence of a gap horizontally between the part 26 and the pocket 25. The third device part 24 is slightly modified in relation to the third device oft shown in FIG. 5.

According to one preferred embodiment of the invention, the first part 2 and the third part 4 of the inventive device are comprised of extruded aluminium sections.

According to another preferred embodiment, the inventive device has a length which is essentially shorter than the length of the top or bottom edge of a facade element 1. FIG. 2 illustrates schematically two of the second parts 3 and two of the third parts 4 fitted to a facade element. As will be seen from the Figure, these device parts are short in relation to the length of the edges of the facade element. It will be understood but the devices my be made longer and may even be given a length which corresponds to the length of the edges of said element.

Figure 3:
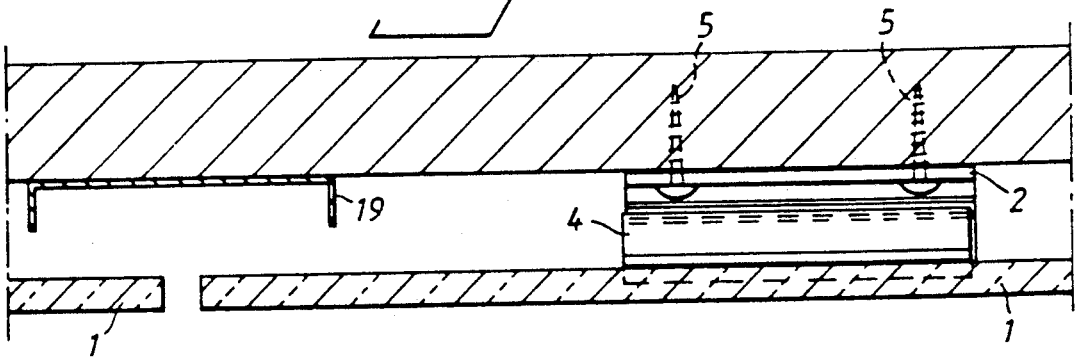
FIG. 3 is a sectional view taken on the line A—A in FIG. 1.

The inventive device is used to secure the upper and the lower edges of facade elements. FIG. 3 is a sectional view taken on the line A—A in FIG. 1. A stormwater gutter 19 can be fitted behind the vertical join between two neigbbouring facade elements, or, alternatively, the join may be sealed with a known elastic sealing compound, not shown. Sealing compound may also be in the horizontal joins between neighbouring facade elements.

It will be apparent from the aforegoing that the present invention solves the problems mentioned in the introduction. An essential feature of the invention is that all gluing can be effected in the factory, since the free bit of the tongues and pockets of the inventive device enables deviations in flatness and in other tolerances to be taken-up when fitting the facade elements, without subjecting the glue joints to static loads.

Although the invention has been described essentially in the aforegoing% with reference to one single exemplifying embodiment, it will be obvious to the skilled person that the three parts 2, 3, 4 of the device may be given other configurations without departing from the function of the device.

The present invention shall not therefore be considered restricted to the aforedescribed and illustrated exemplifying embodiments thereof, since variations can be made within the scope of the following Claims.

I claim:

1. A device for fitting and securing glass facade elements which are flat and have front and rear surfaces and upper and bottom parallel edges, to a building facade, wherein said device includes at least three parts, a first part (2: 22) adapted to be fastened to the facade, a second part (3: 23) which has a first upwardly facing channel (10, 25) and is adapted to be glued to the rear surface adjacent the upper edge of a facade element (1), and a third part (4: 24) which has a first downwardly directed tongue (8) and is adapted to be glued to the rear surface adjacent the bottom edge of a facade element (1); said first part (2) including a second upwardly facing channel (7) which is adapted to coact with said first downwardly extending tongue (8) belonging to the third part (4; 24), and said first part further includes a second downwardly extending tongue (9) which extends parallel with said second channel (7), said second tongue being disposed at a lower level than said second channel (7) and is adapted to coact with an in said first upwardly open channel (18) belonging to the second part (3: 23), said second part being provided with a first flat glue surface (11) which is adapted to be glued to the upper rear surface (12) of a facade element (1); and wherein the third part (4; 24) includes a second flat glue surface (13) which is adapted to be glued to the bottom rear surface (14) of a facade element (1), said second glue surface (13) being parallel with said first tongue (8), and said third part further including a supportive surface (15) which extends at right angles outwardly from said second glue surface (13) and against which the bottom edge (16) of a facade element, to which the third part is adapted to be glued, is intended to rest; and wherein, in a fitted state of facade elements and parts, the distance from a bottom edge (17) of said second tongue (9) on an associated said first part to a bottom (18) of a said first channel (10) of a second part exceeds the depth of the upwardly facing second channel (7) of the associated said first part.

2. A device according to claim 1, characterized in that the width of said second channel (7) is such as to provide a free fit with limited pivotal movement of the downwardly extending said first tongue (8) in said second channel.

3. A device according to claim 1, characterized in that said first channel (10) is made of sheet metal, which is folded to form said first channel and which is resilient in relation to the downwardly extending said second tongue (9) coacting with said first channel (10).

4. A device according to claim 1, characterized in that said first channel (25) is made of a non-resilient material; and in that the downwardly extending said second tongue (26) of said first part (22) has an enlarged end part (26) whose width corresponds to the width of said first channel (25) so that said second part (23) is able to pivot to a limited extend in relation to the first part (22).

5. A device according to claim 1, wherein the first part (2: 22) and the third part (4; 24) of the device are extruded aluminium sections.

6. A device according to claim 1, wherein the device (2; 22, 3; 23, 4; 24) has a length which is essentially shorter than the length of the upper and lower edges of a facade element (1).

* * * * *

UNITED STATES PATENT AND TRADEMARK OFFICE

CERTIFICATE OF CORRECTION

PATENT NO. : 5,301,484

DATED : April 12, 1994

INVENTOR(S) : NILS-GUNNAR JANSSON

It is certified that error appears in the above-identified patent and that said Letters Patent is hereby corrected as shown below:

Column 1, line 48, "kill" should be --kind--.

Column 4, line 26, "but" should be --that--; "my" should be --may--.

, line 47, cancel "%".

Column 5, line 7, "an" should be --and--.

Signed and Sealed this

Sixteenth Day of August, 1994

Bruce Lehman

*Attest:*

BRUCE LEHMAN

*Attesting Officer*

*Commissioner of Patents and Trademarks*